United States Patent [19]

Smith et al.

[11] Patent Number: 4,684,196

[45] Date of Patent: Aug. 4, 1987

[54] ELECTRICAL CLAMP CONNECTOR

[75] Inventors: Philip L. Smith; Joseph R. Caprio, both of Madison, Conn.

[73] Assignee: Kupler Corporation, Branford, Conn.

[21] Appl. No.: 856,455

[22] Filed: Apr. 25, 1986

[51] Int. Cl.[4] ..... H01R 4/24

[52] U.S. Cl. ..... 439/411; 439/781

[58] Field of Search ..... 339/97 R, 97 P, 98, 339/99 R, 246

[56] References Cited

U.S. PATENT DOCUMENTS 4,427,253 1/1984 Smith et al. ..... 339/98

FOREIGN PATENT DOCUMENTS 2903960 8/1980 Fed. Rep. of Germany ..... 339/98

*Primary Examiner*—Joseph H. McGlynn

*Attorney, Agent, or Firm*—Davis Hoxie Faithfull & Hapgood

[57] ABSTRACT

An electrical clamp connector with first and second half portions connected together and providing at least two mating grooves for electrical conductors to be electrically bridged. Bridging plates extend transverse to the grooves in one half portion and oppose corresponding bridging plates in the other half portion. Each bridging plate has first and second sets of piercing teeth to pierce the conductors at the grooves. The second half portion has substantially greater depth than the first half portion. Improved high real torque connecting means are provided by a bolt, a threaded upstanding tubular pipe in the second half portion, a first threaded cylindrical passage underlying the tubular pipe, a flat or curved metal plate with a threaded passage and encapsulated in the second half portion substantially above the bottom of the second half portion, and a second cylindrical passage below the metal plate. The threaded pipe, threaded first cylindrical passage, threaded plate passage, and second cylindrical passage are precisely aligned, and one continuous thread extends through the pipe, first passage and metal plate by means of drilling the passages in one continuous operation and tapping the passages in another continuous operation.

7 Claims, 3 Drawing Figures

ELECTRICAL CLAMP CONNECTOR

BACKGROUND OF THE INVENTION

This invention relates to electrical clamp connectors for electrical conductors. More particularly, the invention is directed to a clamp connector that can accommodate a wide range of conductor sizes but is particularly adapted to a middle range of sizes, and that further can accommodate insulated conductors, bare conductors or a combination thereof. An improved connecting means allowing higher real torque is provided to connect the connector halves about the conductors while retaining the threaded end of the connecting bolt entirely within the connector body.

Electrical clamp connectors are known in the prior art having two half portions of electrically insulating material with a plurality of lengthwise grooves therein, the grooves of the connector halves mating and enclosing electrical conductors when the connector half portions are bolted together. Opposing electrical bridging members in the connector half portions extend transverse to the grooves and have piercing teeth protruding into the respective grooves to pierce the insulation of the electrical conductors from both sides and thus create electrical "bridging" between separate conductors within the connector for purposes of splicing the conductors or providing a tap-off connection.

Prior art connectors commonly are fastened by one or more bolts passing through both connector halves and each being captured by a nut member positioned at the opposite side of the connector from the bolt head, the threaded bolt end generally extending through and jutting out the bottom of the connector. The bolt end will necessarily extend out the bottom of the connector since the bolt generally engages the nut while the connector halves are partially separated to allow insertion of the conductors into the connector; the bolt, upon being torqued to thereafter bring the connector halves together about the conductors, will pass through and beyond the nut and thus the adjacent connector half for a distance up to as much as an inch or so. However, the exposed bolt end can abrade and damage surrounding conductors in an electrical installation enclosure, as well as cut or injure an installer in an electrical installation enclosure and cause discomfort to an installer's hand when making a number of such connections at the same time. The exposed bolt end also occupies space in installation enclosures where available space is often very limited. Prior art bolt connection means further do not always provide a sufficient strength of connection, and are prone to failure through inadvertent over-tightening.

A new connector is disclosed in our co-pending U.S. patent application Ser. No. 733,630 filed May 13, 1985 wherein the threaded end of the bolt does not extend through the connector but rather is retained within a pre-threaded elongated metal insert encapsulated within one of the two connector half portions. The metal insert has a lower flange positioned adjacent the bottom of its connector half-portion and has an elongated and profiled portion internally threaded and extending upwardly from the flange into a smooth-walled tubular insulating pipe upstanding from the connector half portion. The bolt screws solely into the metal elongated portion of the metal insert when the connector halves are connected together, and the two connector halves are of essentially the same depth in a direction along the bolt axis. While this design has its advantages and will work with all sizes of conductors, medium to larger size conductors require the elongated and profiled portion of the metal insert to have thicker walls in order to avoid bending or fracture of the insert when the higher installation torques associated with larger conductors are applied. The cost of the thicker elongated metal inserts thus becomes significant.

An additional defect of exposed bolt prior art connectors, when used with bare wire conductors, is that the connectors do not provide adequate means to retain sufficient holding of the wires after the bare wires have undergone cold flow upon piercing by the teeth and also after the connector and its wires have been cycled a number of times through the high temperatures found in a bare wire connector environment. The holding power of such prior art connectors radically decreases because of such cold flow and temperature cycling.

SUMMARY OF THE INVENTION

The present invention provides a connector that can be used with a wide range of sizes of electrical conductors, is particularly adapted to a middle range of sizes, and will function equally well with bare, insulated, or a combination of both types of conductors. The invention includes the two plastic connector half portions with the electrical bridging members, the bottom connector half portion being of considerably greater dimension along the bolt axis than the top connector half portion. The invention further provides an improved means of connecting the connector halves to provide a very strong connection by means of a threaded metal plate that is encapsulated at a particular position entirely within the connector body. The threaded attaching bolt remains fully within the connector when the connector is installed about the conductors.

In particular, the threaded metal plate is positioned a substantial distance above the bottom of its associated connector half and underlies the electrical bridging members and their respective teeth of the associated connector half. The metal plate is further separated by a thickened plastic portion of particular dimension from the bottom of the electrical bridging members held within the connector half portion. The metal plate is initially encapsulated by molding within the connector half. From the top to the bottom of the connector half, a tubular plalstic pipe, the plastic material overlying the encapsulated metal plate, the metal plate and the plastic material underlying the metal plate, are all drilled in a continuous operation and tapped in a continuous operation to provide threaded passages of constant diameter which are perfectly aligned and which have one continous thread extending through all of these respective parts. The connector attaching bolt interacts with the threaded plastic passages above the metal plate to provide a substantial torque and thereafter, when screwed through the threaded metal plate, provides an ultimate real torque of high value and with much less false torque than found in conventional connectors.

The particular construction of the present invention, including the aligned passages, the single continuous thread, and thickened plastic portion, results in much less false torque and in the bolt and metal plate acting as the primary load bearing members; the thickened plastic portion also acts in compression as a spring force to maintain a large continuing torque on the connection even after bare wire cold flow and continual high temperature cycling common particularly in a bare wire environment.

The present invention, when used with mid-size conductors, also eliminates the need for expensive elongated and profiled, threaded metal inserts, thus resulting in a more inexpensive construction.

Other details and advantages of the present invention are disclosed in the drawings and the following detailed description.

DETAILED DESCRIPTION OF INVENTION

Figure 1:
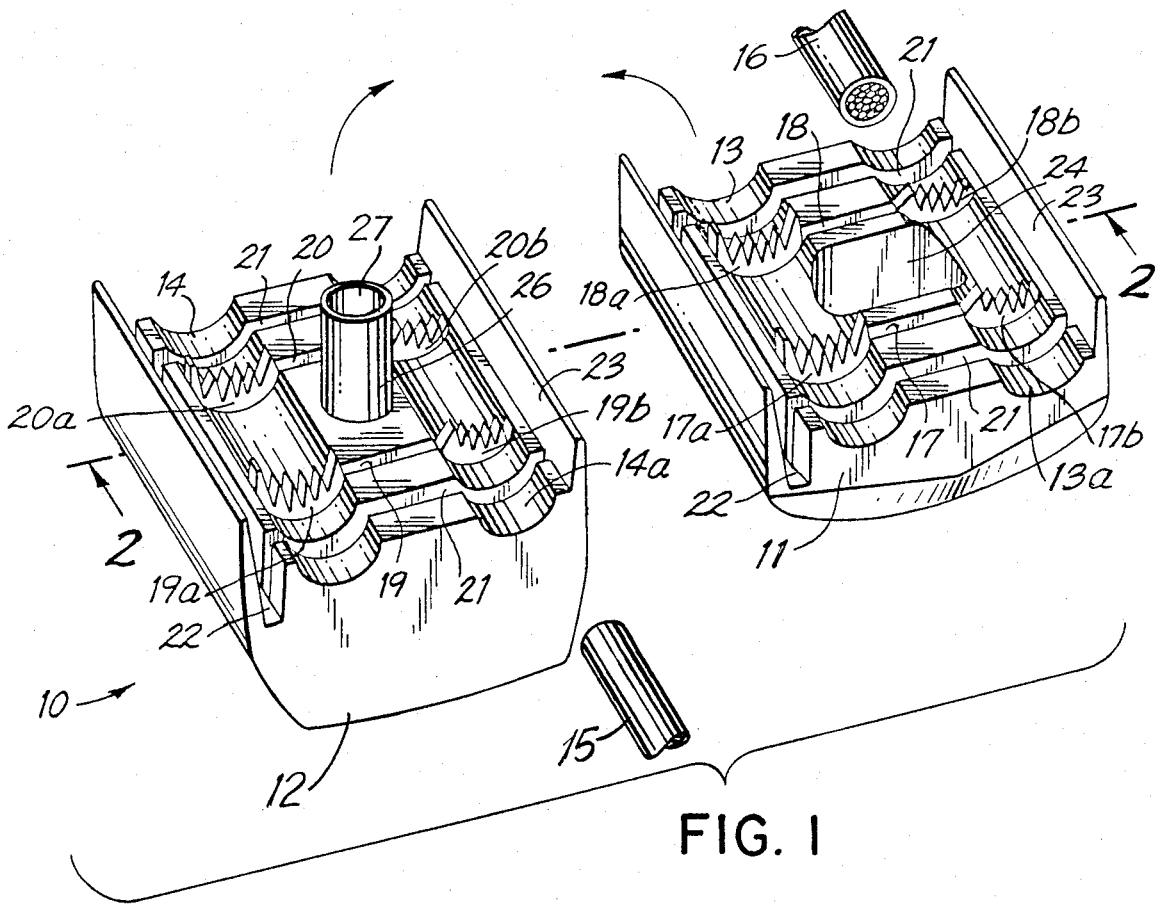
FIG. 1 is a view of a disassembled connector of the present invention, illustrating the two connector halves in perspective.
Figure 2:
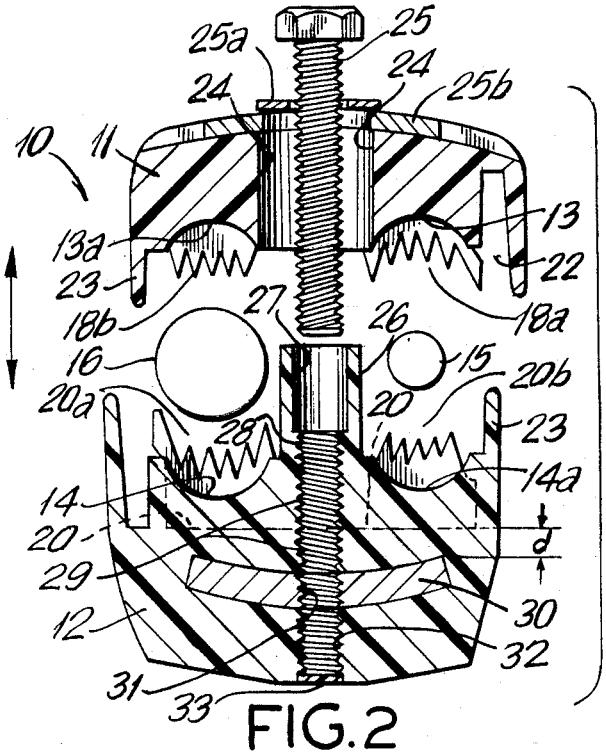
FIG. 2 is a cross-sectional view along lines 2—2 of FIG. 1, and with the two connector halves of FIG. 1 rotated with respect to each other preparatory to being bolted together about electrical conductors.

Referring to FIGS. 1 and 2, electrical clamp connector 10 is shown comprised of first and second half portions 11 and 12 molded of plastic electrically insulating material. First half portion 11 has grooves 13 and 13*a* extending lengthwise therein, and second half portion 12 likewise has grooves 14 and 14*a* extending lengthwise therein. When the connector half portions 11 and 12 of FIG. 1 are rotated with respect to each other, they assume the position shown in FIG. 2 preparatory to bolting the halves together about stranded electrical conductors 15 and 16 to be electrically joined and which may be of widely varying sizes and bare and/or insulated. Grooves 13*a* and 14 form one mating groove to enclose conductor 16 and grooves 13 and 14*a* form a second mating groove to enclose conductor 15.

The connector first half portion 11 has two conductive metal electrical bridging members or plates 17 and 18 extending transverse to grooves 13 and 13*a*, the bridging members 17 and 18 being captured (as by barbs) within and extending to the bottom of slots in the body of first half portion 11. Likewise, the connector second half portion 12 has two conductive metal electrical bridging members or plates 19 and 20 extending transverse to grooves 14 and 14*a*, the bridging members 19 and 20 being captured within and extending to the bottom of slots in the body of the second half portion 12; the continuation to the bottom of such a slot by bridging member 20 is shown in dotted line in FIG. 2. When the connector half portions 11 and 12 are assembled together about conductors 16 and 15, bridging member 17 in the first half portion 11 is aligned over and directly opposes bridging number 19 in second half portion 12, and bridging member 18 in first half portion 11 is aligned over and directly opposes bridging member 20 in second half portion 12. Alternatively, bridging members 17 and 19 may be slightly misaligned in the lengthwise direction, though of course still opposing; the same may be true of bridging members 18 and 20. Bridging member 17 includes a first set of piercing teeth 17*a* and a second set of piercing teeth 17*b*. Likewise, bridging members 18,19 and 20 respectively have first sets of piercing teeth 18*a*, 19*a* and 20*a*, and second sets of piercing teeth 18*b*,19*b* and 20*b*. Bridging members 17,18,19 and 20 are identical to one another, and the teeth thereof will pierce well into the strands of conductors 15 and 16 when the connector half portions 11 and 12 are fully bolted together about the connectors.

First and second connector half portions 11 and 12 may also include one or more slots 21 for the insertion of inboard insulating tabs (not shown), and side channels 22 and opposing legs 23 for interfitting upon assembly to provide long leakage paths. These slots, tabs, channels and legs do not form a part of the present invention, and are more fully described in our U.S. Pat. No. 4,427,253 of Jan. 24, 1984 for "Fully Insulated Electrical Clamp Connector With Inboard Insulating Tab and Slot".

First connector half portion 11 includes oblong bolt hole 24 extending therethrough and through which threaded bolt 25 passes after passing through washer 25*a* and stress-distributing plate 25*b*. The oblong bolt hole 24 allows sufficient transverse spacing from bolt 25 so that first half portion 11 may rock (rotate) in either direction along the arrow shown in FIG. 2 with respect to second half portion 12 in order to accommodate and pierce varying and unequal sizes of conductors 15 and 16. Conductors 15 and 16 are shown diagrammatically, solely for purposes of illustration, as one smaller conductor 15 and one larger conductor 16; however, this sizing may be reversed or the conductors may be of equal size.

Figure 3:
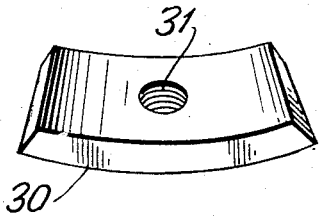
FIG. 3 illustrates in perspective a metal plate member to be encapsulated at a certain position within a connector half and utilized in bolting the two connector halves together about electrical conductors.

Connector second half portion 12 has an elongated tubular insulating pipe 26 integral with and upstanding from half portion 12. Referring now to FIG. 2 and the means for connecting together the connector halves 11 and 12, FIG. 2 being a cross-section through the center of tubular pipe 26 (bolt 25 showing in elevation), it will be noted that tubular insulating pipe 26 has a smooth inner surface 27 at the top thereof, slightly larger in diameter than the diameter of bolt 25 in order that bolt 25 may easily enter pipe 26. Beginning a portion of the way down pipe 26, internal threads 28 commence and continue the rest of the way down pipe 26. The internal threads 28 of pipe 26 in turn extend in continuous fashion as threaded cylindrical passage 29 down through the plastic of connector second half portion 12 to the top of metal plate 30, continuing as threaded cylindrical passage 31 in plate 30, and as threaded cylindrical passage 32 in the plastic from the bottom of metal plate 30 to the bottom of connector half portion 12. As can be seen in FIG. 2, the internal threaded diameter is the same value for pipe 26, passage 29, passage 31 and passage 32. Threaded pipe 26 and threaded passage 29 precisely align bolt 25 with the threaded passage 31 in metal plate 30 to eliminate false torque from misalignment. Metal plate 30, more fully shown in FIG. 3, extends out under teeth 20*a* and 20*b* as shown in FIG. 2, and also extends lengthwise parallel to the axis of the conductors 15,16 so as to underly teeth 19*a* and 19*b*. Threaded metal plate 30 may be flat, or slightly curved as shown in FIGS. 2,3 to counteract the stress and bending moment applied when bolt 25 is tightened into plate 30. Bolt 25 when applied is sequentially threadably connected with threaded pipe 26, threaded cylindrical passage 29 in connector half portion 12, threaded cylindrical passage 31 in metal plate 30, and threaded cylindrical passage 32 in connector half portion 12, in order to bring the teeth sets 18*b*-20*a*, 18*a*-20*b*, 17*b*-19*a* and 17*a*-19*b* into piercing relation with conductors 16 and 15 respectively.

The above-described connective construction is obtained during the molding of plastic connector half portion 12. In particular, metal plate 30, which may be of high strength steel, is fully encapsulated within half portion 12 in the position shown by molding half portion 12 thereabout. During the molding operation, tubular pipe 26 and the underlying connector half portion 12 will be formed and molded around an axially-extending pin in the molding machine of smaller diameter than the ultimate inner diameter of tubular pipe 26 and passages 29 and 32 as shown in FIG. 2. The pin axially extends through pipe 26 and straight down through the body to the bottom of connector half portion 12 as molded thereabout, and thus will also extend through a pre-formed and non-threaded hole in positioned metal plate 30, the pre-formed hole also being smaller in diameter than the ultimate threaded passage 31 shown in FIGS. 2, 3. After the conventional molding operation of connector half portion 12, the connector half portion 12 with the encapsulated plate 30 is removed from the molding pin. The tubular pipe 26 and connector half-portion 12 including now-encapsulated metal plate 30 are then drilled therethrough from top to bottom in a first continuous operation, and tapped therethrough from top to bottom in a second continuous operation, along the axis of pipe 26 to provide a larger diameter, continuously extending, threaded and aligned opening from pipe 26 to the bottom of connector half 12. It is highly important to the present invention that this female thread, to mate with threaded bolt 25, extend as one continuous thread from the tubular pipe 26 into and through cylindrical passage 29 and into and through the passage 31 in metal plate 30 (the thread in cylindrical passage 32 results from the tapping operation but is not required). Without the one continuous thread, for example if the opening in metal plate 30 were pre-threaded before being encapsulated, bolt 25 would hang up or create false torque at the intersection of the plastic threaded passage 29 and a threaded metal plate passage 31; this not only because the thread would not be continuous, but also because the threaded passage 29 and pre-threaded passage in plate 30 would inherently be somewhat misaligned because of molding limitations preventing precise alignment. To complete the construction, plastic plug 33 is glued into hole in the bottom of connector half portion 12 to prevent exposure and corrosion of the threads of the bolt 25 and the threads of the metal plate 30.

Within the range of conductors to be used with the present invention, for example in a size range of 250 MCM to No. 4 AWG, bolt 25 will not extend beyond and outside of connector half portion 12. With conductors on the larger side of the intended range, the bolt 25 will just pass through metal plate 30 and terminate on the opposite side thereof. With conductors on the smaller side of the intended range, the bolt will pass some distance beyond metal plate 30 into cylindrical passage 32, but will not extend outside of connector half portion 12. It is therefore important that metal plate 30 extend a substantial distance up from the bottom of connector half portion 12 in FIG. 2. In a sample embodiment, plate 30 will be approximately one-quarter inch thick and may be encapsulated within connector half portion 12 approximately one-half inch up from the bottom thereof. From the top of metal plate 30 to the top of pipe 26, the distance may approximate one and a half inches, with pipe 26 being approximately three quarters of an inch in length. Connector half portion 12 is therefore of considerably greater depth in the vertical direction of FIG. 2 as compared with connector half portion 11.

When installing the connector of the present invention, the connector half portions 11,12 are initially brought into the position of FIG. 2 and threaded bolt 25 is initially screwed a small distance into the threaded tubular pipe 26 so that the half portions are loosely connected but still partially separated. Conductors 15 and 16 are then inserted through the still-open sides of the connector. The bolt 25 is then screwed further into threaded tubular pipe 26 and threaded cylindrical passage 29. Just before engaging the threaded metal plate 30, there can (in the instance of large conductors) be as much as fifteen foot pounds of torque on the bolt merely due to the threaded connection of the bolt 25 and the plastic threaded pipe 26 and passage 29. The bolt 25 after it is screwed into and through threaded metal plate 30 will have approximately thirty foot pounds of torque thereon in certain applications. Metal plate 30 as noted underlies both bridging members 19,20, and may be curved if desired, to alleviate the bending moments in connector half portion 12. Because of the perfect alignment and one continuous thread of the threaded tubular pipe 26, passage 29 and passage 31 in metal plate 30, as obtained by the aforementioned continous drilling and continuous tapping operations, there is much less false torque than in conventional connectors, and the amount of torque being applied by the installer is a much more accurate measurement of the real torque on the connection. In prior art connectors, it is well known that the torque applied by the installer is an often inaccurate measurement of real torque due to misalignment of parts and the bolt or other parts of the connector binding on parts not directly involved in the tightening of the bolt to a nut; consequently, installers often inadequately tighten prior art connectors or over-tighten prior art connectors to the point of failure.

It is also important to the present invention that plate 30, in its unloaded condition (i.e. where it is not stressed by bolt 25), lie within a certain range of distance below the bottom of the metal bridging members 19,20, shown as vertical distance d in FIG. 2 which is the closest vertical distance in the case of a curved plate 30. Distance d should be adequate to prevent undue electrical stress between the metal bridging members 19,20 and metal plate 30, and should also be sufficient to create adequate compression and displacement of the plastic material in distance d upon loading or tightening of the connector for the reasons described below. Distance d, however, should not be so great as to prevent metal plate 30 from functioning as the main torque bearing member with bolt 25; too great a distance d will result in significant plastic flow under the high torques associated with the present invention. We have discovered that a distance d, when the connector is not loaded, of approximately 0.100 inches as a minimum to approximately 0.200 inches as a maximum will satisfy the above criteria, this range of distance being greater than that present in prior art connectors. Distance d thereby represents a thickened portion of material to accomplish the above aims.

As noted, unloaded distance d needs to be sufficient to create adequate compression and vertical displacement of the plastic material in that distance between the bridging members 19,20 and the plate 30 upon loading by fully tightening the connector halves about the conductors. In particular, bare wires may be used with the present connector and bare wires when pierced by connector teeth will undergo cold flow because of the absence of restraining insulation about the wires. The operating temperature cycling differentials from bare wire connectors also can result in considerable expansion and contraction of the connector parts. Although a connector is installed at a certain level of torque on the bolt, bare wire cold flow and the continued expansion and contraction of the connector generally result in a considerable reduction of the initial torque in prior art connectors. By making the unloaded distance d above of a sufficient amount as described, the installation torque applied to the present invention (when fully installed about the conductors) can be largely maintained despite the cold flow and high temperature cycling. The installation torque of bolt 25 and plate 30 provides compression of the thickened plastic portion d (for example of the order of approximately three per cent in commonly used plastics suitable for electrical connectors) by virtue of bridging members 19,20 being pressed downwardly by conductors 15,16 against the bottom of their slots. The compression and resulting displacement in thickened portion d between the bridging members 19,20 and plate 30 in turn provides a sufficient spring force acting upwardly against the bridging members 19,20 and thus through their respective piercing teeth sets against the pierced conductors 15,16. As the connection tends to loosen, the thickened portion d allows the material in that portion to remain in some degree of compression and thus to retain the upward spring force. It has been found that the present invention will maintain approximately seventy-five percent of the real initial installation torque after constant temperature cycling, as opposed to far less values in the prior art.

It should be understood that various modifications of the present invention may be made without departing from the spirit and scope of the invention as hereinafter claimed.

What is claimed is:

1. An electrical clamp connector, comprising: first and second half portions molded of electrically insulating material and means to connect said half portions together; each half portion having at least two lengthwise grooves therein, the grooves mating and serving to enclose electrical conductors upon connecting of the two half portions together; at least two electrical bridging members in the first half portion extending transverse to the respective grooves therein and positioned opposite correspondingly positioned electrical bridging members in the second half portion; each bridging member having a first set and second set of piercing teeth respectively protruding from two grooves of its half portion; the means to connect the half portions together comprising an oblong bolt opening in the first half portion, a threaded bolt for passing through the bolt opening, a generally tubular pipe of insulating material integral with and upstanding from the second half portion and positioned between the grooves and the bridging members of the second half portion, said tubular pipe of insulating material having a central opening through its length and internal threads through at least a portion of its length, a metal plate with a threaded central passage therethrough and encapsulated within the second half portion at a substantial distance above the bottom surface of the second half portion, a first cylindrical threaded passage extending in said second half portion between said tubular pipe and said metal plate, and a second cylindrical passage extending in said second half portion between said metal plate and the bottom surface of the second half portion; the threaded central opening of the tubular pipe, the first cylindrical threaded passage, the threaded passage through the metal plate, and the second cylindrical passage all being precisely axially aligned; the threads of the tubular pipe, first cylindrical passage and metal plate passage forming one continuous thread for interacting with the threaded bolt; and, the bolt terminating within the body of the second half portion when the first and second half portions are bolted together about conductors.

2. The invention of claim 1, wherein the connector second half portion has a substantially greater depth dimension along the bolt axis than the connector first half portion.

3. The invention of claim 1, wherein the metal plate extends under the bridging members and the piercing teeth thereof.

4. The invention of claim 3, wherein the metal plate is curved in a direction toward the tubular pipe.

5. The invention of claim 1 or claim 3 or claim 4 or claim 2, wherein the metal plate is positioned in the second half portion in a range of distance below the bottom of the electrical bridging members, the said distance being sufficient to substantially compress and displace the electrically insulating material between the plate and bridging members when the connector is fully loaded and the distance being limited to a value permitting the metal plate to act as the primary load bearing member when the connector is fully loaded.

6. The invention of claim 5, wherein the range of distance lied between approximately 0.100 and 0.200 inches.

7. A method of forming a electrical clamp connector having first and second half portions and connective means in the second half portion for interacting with a threaded bolt passing through the first half portion, comprising molding a first half portion of electrically insulating material; molding a second half portion of electrically insulating material with an upstanding tubular insulating pipe and with an underlying metal plate encapsulated within the second half portion at an intermediate distance between the top and bottom surfaces thereof; drilling in one continuous operation an axial passage of predetermined diameter from the top of the tubular pipe down through the pipe, the second half portion overlying the metal plate, the metal plate and the second half portion underlying the metal plate; and tapping the drilled passage in one continuous operation to form one continuous bolt-interacting thread through at least a portion of the tubular pipe, the second half portion overlying the metal plate, and the metal plate.

* * * * *